US006595712B2

(12) United States Patent
Sickler

(10) Patent No.: US 6,595,712 B2
(45) Date of Patent: Jul. 22, 2003

(54) WASH BRUSH SYSTEM WITH REMOVABLE HEAD

(75) Inventor: Vicki Sickler, Emporia, KS (US)

(73) Assignee: Hopkins Manufacturing Corporation, Emporia, KS (US)

( * ) Notice: Subject to any disclaimer, the term of this patent is extended or adjusted under 35 U.S.C. 154(b) by 0 days.

(21) Appl. No.: 10/298,029

(22) Filed: Nov. 15, 2002

(65) Prior Publication Data

US 2003/0108378 A1 Jun. 12, 2003

Related U.S. Application Data

(63) Continuation of application No. 09/837,088, filed on Apr. 18, 2001, now Pat. No. 6,488,432.

(51) Int. Cl.[7] ..... A46B 11/06; A47L 13/22

(52) U.S. Cl. ..... 401/289; 401/137; 401/139; 401/270; 401/290

(58) Field of Search ..... 401/136, 137, 401/139, 146, 263, 270, 275, 289, 290

(56) References Cited

U.S. PATENT DOCUMENTS 371,515 A * 10/1887 Nowotny ..... 401/137
854,151 A * 5/1907 Deasy ..... 401/284
1,147,332 A * 7/1915 McNeill et al. ..... 403/245
1,903,896 A * 4/1933 Greenberg ..... 401/137
2,686,694 A * 8/1954 Freeman ..... 239/120
2,815,989 A * 12/1957 McCrink ..... 403/320
2,910,711 A * 11/1959 Mizelle ..... 401/48
2,975,463 A * 3/1961 Morris ..... 401/137
3,183,540 A * 5/1965 McCrink ..... 15/145
3,989,390 A * 11/1976 Thorner ..... 401/42
4,136,419 A * 1/1979 Hetman et al. ..... 15/302
4,764,047 A * 8/1988 Johnston et al. ..... 401/289
4,778,298 A * 10/1988 Shin et al. ..... 401/27
4,895,468 A * 1/1990 Chappell ..... 401/270
4,933,016 A * 6/1990 Carlson ..... 134/18
5,161,278 A * 11/1992 Tomm ..... 15/159.1
5,172,447 A * 12/1992 Tomm ..... 15/159.1
5,274,872 A * 1/1994 Rich ..... 15/145
5,414,889 A * 5/1995 Sartori ..... 15/159.1
5,924,816 A * 7/1999 Schuele ..... 403/371
5,964,005 A * 10/1999 Williams et al. ..... 15/115
5,988,912 A * 11/1999 Chen ..... 401/42
6,019,537 A * 2/2000 Hunt ..... 401/203

* cited by examiner

*Primary Examiner*—Tuan N. Nguyen
(74) *Attorney, Agent, or Firm*—Hovey Williams LLP

(57) ABSTRACT

A wash brush (10) having a handle (11) securely coupleable with a cleaning head (13) by a ratchet-like coupling mechanism (12), and including a flowpath control mechanism (22) operable to direct and control a stream of liquid to the brush head area. A continuous liquid flow path is provided from a handle source connection end (62) to the head-mounted flowpath control mechanism (22) which is operable to selectively control flow characteristics, including pattern and direction.

21 Claims, 4 Drawing Sheets

WASH BRUSH SYSTEM WITH REMOVABLE HEAD

RELATED APPLICATIONS

The present application is a continuation of and claims priority benefit of the filing date of U.S. non-provisional patent application titled "Wash Brush System with Removable Head", Ser. No. 09/837,088, filed Apr. 18, 2001 Now U.S. Pat. No. 6,488,432, and is also related to copending U.S. non-provisional patent application titled "Ratchet Mechanism For Connecting A Cleaning Head To A Handle", Ser. No. 09/836,930, filed Apr. 18, 2001, which is hereby incorporated by reference into the present application.

BACKGROUND OF THE INVENTION

1. Field of the Invention

The present invention relates to handled cleaning tools. More particularly, the invention relates to a wash brush having a handle securely coupled with a cleaning head by a ratchet-like coupling mechanism, and operable to direct and control a flow of liquid to the brush head area.

2. Description of the Prior Art

Brushes, brooms, and similar tools have long been used to sweep, scrub, mop, or otherwise clean various surfaces or objects as needed. Typically, these tools comprise a handle and cleaning head, with the head presenting a cleaning material of some sort, such as bristles, scrubbing pads, or absorbent material. Further, the head is typically removably coupled with the handle so as to allow for easy cleaning and storage and replacement of dirty or worn heads, or changing to a different handle having some desired characteristic such as a longer or shorter length.

Those with ordinary skill in the art will appreciate that numerous coupling mechanisms exist for connecting a cleaning head to a handle. Perhaps the most well known coupling mechanism involves threading an end portion of the handle so that it may be threadably received within a corresponding recess in the head. Unfortunately, the threads often strip due to overtightening, or the handle undesirably "backs out" or un-threads during use. Other coupling mechanisms use complicated and expensive interlocking members, secured to or incorporated into one or both of the head or handle. The complexity of these latter mechanisms make them prone to wear and breakage, and can substantially increase the cost of the tool. Still another category of coupling mechanisms exists that relies on points or teeth to bitingly engage the handle or head. These mechanisms can cause degradation over time of the handle material, or make disconnection difficult.

Many existing cleaning tools are also specifically adapted to particular functions and applications. For example, in a wash brush it is often desirable to direct and control the application of liquid through, on, or near the cleaning head, as, for example, when washing a vehicle. Existing wash brush designs for accomplishing such are varied. For example, some simply use brackets or similar devices to couple a wash brush and handle to a conventional water wand, which is, in turn, connected to a water supply. This design results in a heavy, unwieldy composite device unsuitable for many operators or applications. Unfortunately, even expensive and complex wash brush designs, which incorporate water delivery into the wash brush itself, do not allow for sophisticated control over the release or application of the liquid.

Due to the above-identified and other problems in the art, a need exists for a wash brush having an improved coupling mechanism and an improved liquid delivery and control mechanism.

SUMMARY OF THE INVENTION

The wash brush of the present invention overcomes the above-identified and other problems in the art to provide a simple and inexpensive tool having a reliably coupled handle and cleaning head and including a mechanism whereby one or more characteristics of a release of a liquid flow at the head can be conveniently controlled.

The preferred wash brush broadly comprises a handle, a coupling mechanism, and a cleaning head. The handle is one of a selection of elongated, hollow handles having various useful lengths, each being connectable with a liquid supply source, such as a common garden hose, and providing a first flowpath. The coupling mechanism is preferably a rachet-like mechanism with releasable engaging teeth to securely couple handle to head and prevent inadvertent decoupling. The head provides a second flowpath alignable with the handle's first flowpath to deliver a flow of liquid from the liquid supply source to a flowpath control mechanism coupled with or incorporated into the head and operable to control release of the liquid. For example, the control mechanism may be operable to control angle and pattern of release, including focused jet spray and diffuse fan spray. The head further includes a convenient grip facilitating the application of additional scrubbing pressure or more precise control of head movement. The grip also facilitates use of the head without the handle, as, for example, where close scrubbing is desired. A cleaning material, such as brush bristles or a sponge, depends from the head, being either permanently or removably attached thereto.

These and other important aspects of the present invention are more fully described in the section entitled DETAILED DESCRIPTION OF A PREFERRED EMBODIMENT, below.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Figure 1:
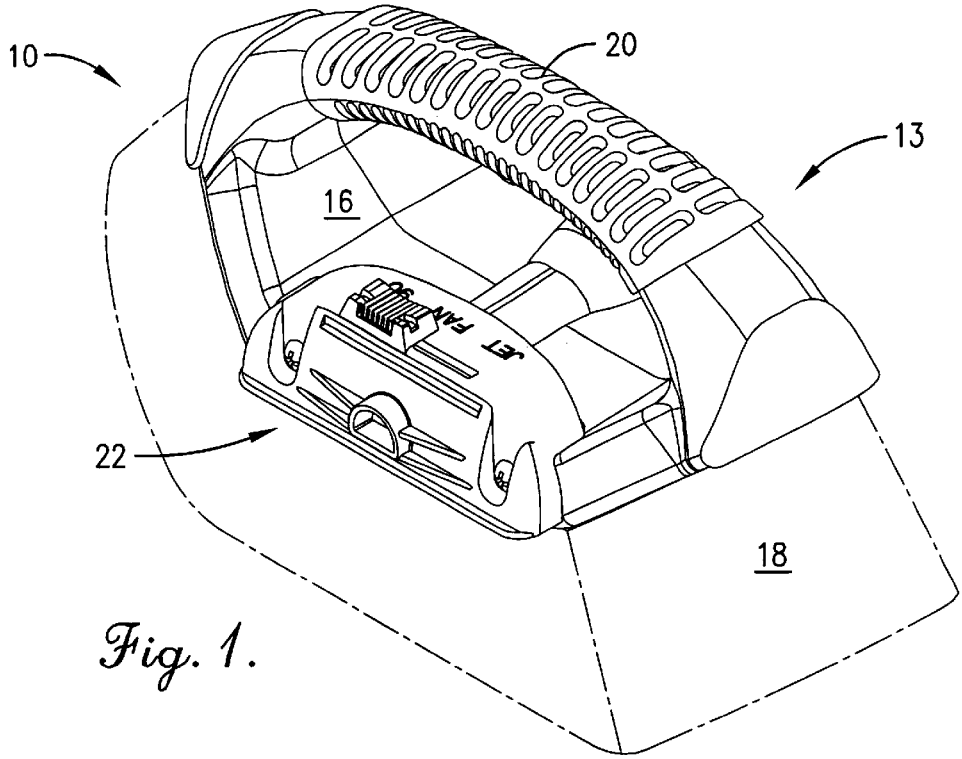
FIG. 1 is an isometric view of a preferred embodiment of the head portion of the present invention.
Figure 3:
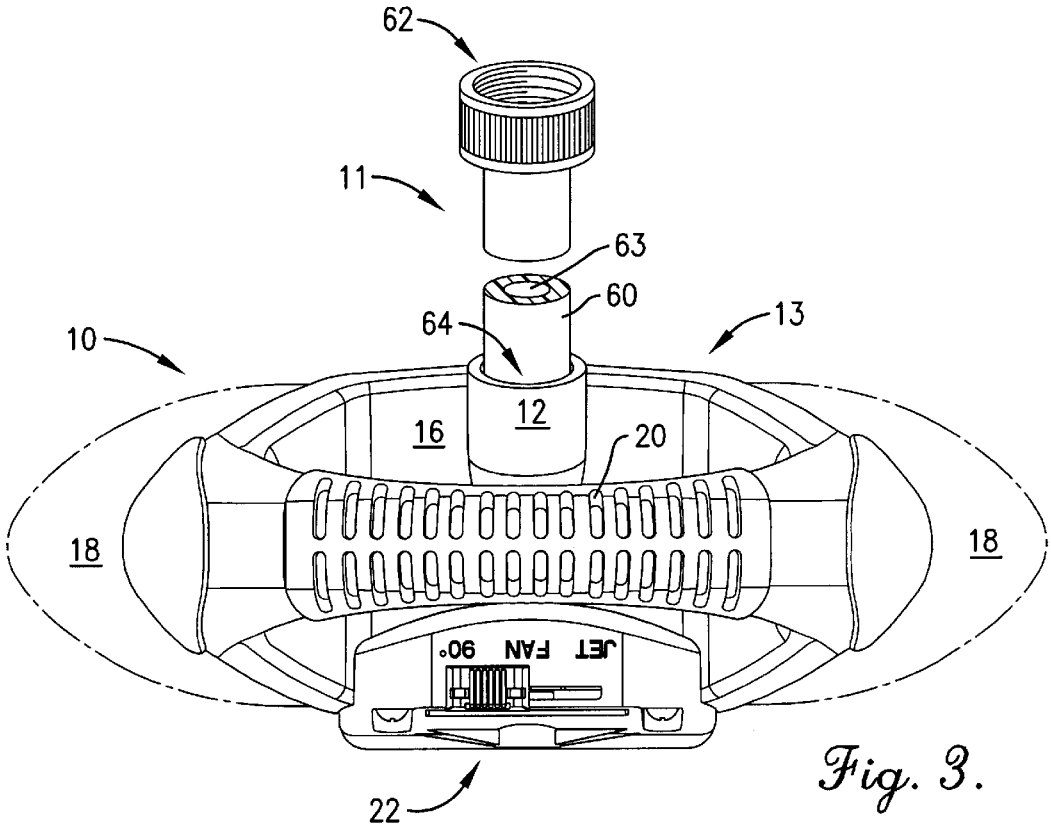
FIG. 3 is a top plan view of a preferred embodiment of the present invention.

Referring to FIGS. 1 and 3, a wash brush tool 10 is shown constructed in accordance with a preferred embodiment of the present invention and operable to direct and control a flow of liquid for application to a surface being cleaned. The preferred wash brush 10 broadly comprises a handle 11; a coupling mechanism 12; and a head 13, with the head 13 including a head body 16; a cleaning material 18; a grip 20; and a flowpath control mechanism 22.

The handle 11 provides a means of controlling application of the head 13 to the surface or object being cleaned. Preferably, a plurality of handles are available for coupling with the head 13, with each handle having different application specific characteristics, such as length. Thus, at least three different handles are contemplated: a long pole-like handle, an intermediate length general purpose handle, and a short handle. Alternatively, a single handle may be used which is adjustable in length or other relevant characteristics.

The handle 11 broadly comprises an elongated hollow cylindrical body 60 having first and second ends presenting, respectively, a source connection 62 and a head connection 64. The handle body 60 is preferably made of plastic, though other materials, including reinforcing materials, may be used or added where desirable and practical. The handle body 60 is hollow so as to allow liquid to flow along a first flowpath 63 from the source connection 62 to the head connection 64.

The source connection 62 is connectable to a liquid supply source, such as a common garden hose. Thus, the source connection 62 preferably presents either a male or female threaded portion depending on the nature of the source to which it is to be connected.

The head connection 64 is adapted and operable to securely engage the coupling mechanism 12 without obstructing the flow of liquid through the handle body 60 into the head 13. A set of teeth (not shown, see copending application) are arranged circumferentially about the head connection portion 64.

The head-to-handle coupling mechanism 12 has directionally interlocking first and second ratchet-like teeth (not shown, see copending application) operable to releasably engage one another to securely couple the head 13 with the handle 11. The first teeth are presented by an engagement arm coupled with the handle 11 or with a handle adapter (not shown); the corresponding second teeth are presented by an engagement wheel secured to or incorporated into the head. The coupling mechanism 12 is described in greater detail in the copending application titled "Ratchet Mechanism For Connecting A Cleaning Head To A Handle", Ser. No. 09/836,930, filed Apr. 18, 2001, which is incorporated herein by reference.

Figure 4:
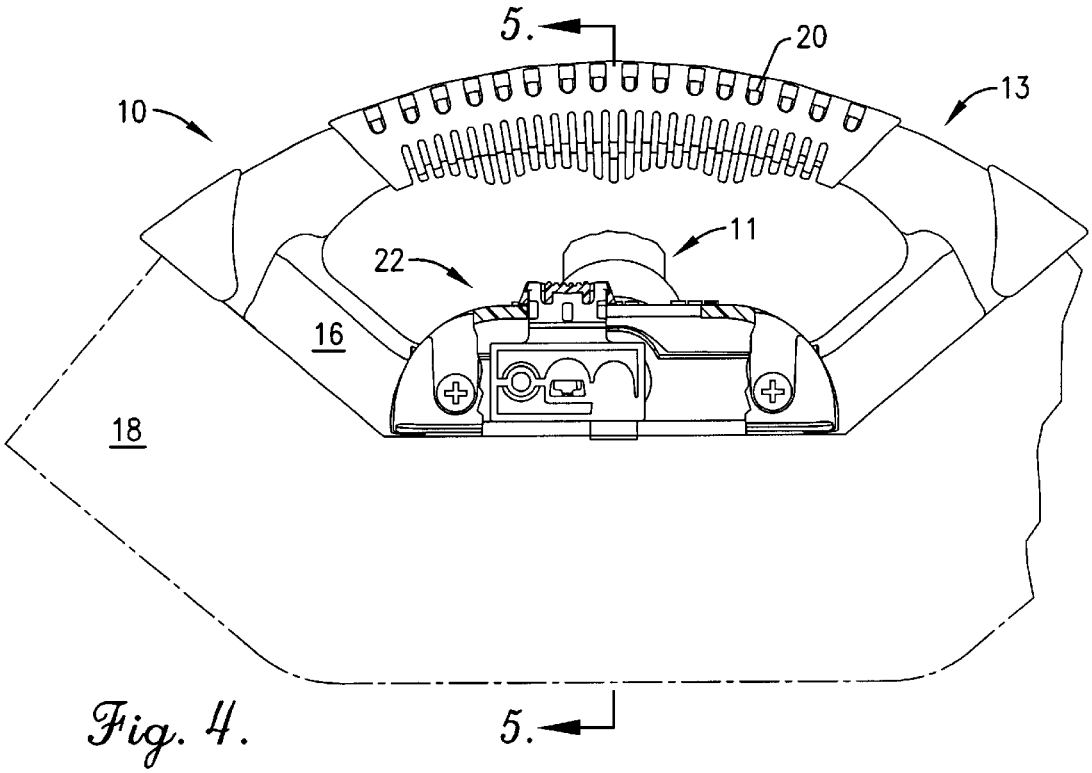
FIG. 4 is a fragmentary sectional front elevational view of the preferred embodiment shown in FIG. 3.

Referring also to FIG. 4, the head 13 includes the head body 16; the cleaning material 18; the grip 20; and the flowpath control mechanism 22. The head body 16 provides a mounting platform for the other head components, and thus may be of any suitable material and shape, but is preferably made of plastic and presents top, bottom, front, and rear portions. As is shown in FIG. 5, the body 16 includes a second flowpath 21 extending therethrough which is alignable with the first flowpath of the handle 11 to result in a continuous flowpath extending from the source connection 62 to the flowpath control mechanism 22.

The cleaning material 18 is operable to clean in some manner as determined by its nature and characteristics, which are, in turn, application dependent. Thus, for example, the cleaning material 18 may be soft bristles suitable for washing a vehicle or other surface or object without scratching a finish; hard bristles suitable for scrubbing a floor or such; or absorbent material suitable for mopping, such as a sponge. Regardless of its exact nature, the cleaning material 18 is secured, either permanently or removably, to the bottom of the head body 16. Where the cleaning material 18 is removable from the head 11, a simple attachment mechanism (not shown) is incorporated into the head body 16 so that the cleaning material 18 may be easily replaced by the same or another material as desired.

The grip 20 provides a means whereby additional control or force may be obtained over or applied to the head body 16. The grip also facilitates use of the head 13 without the handle 11, as, for example, where close scrubbing is desired. The grip 20 is preferably constructed from or covered by a non-slip material and projects from the top of the head body 16 so that an operator may conveniently take hold of the grip 20 without interfering or adapting any other functions or components of the wash brush 10.

Figure 2:
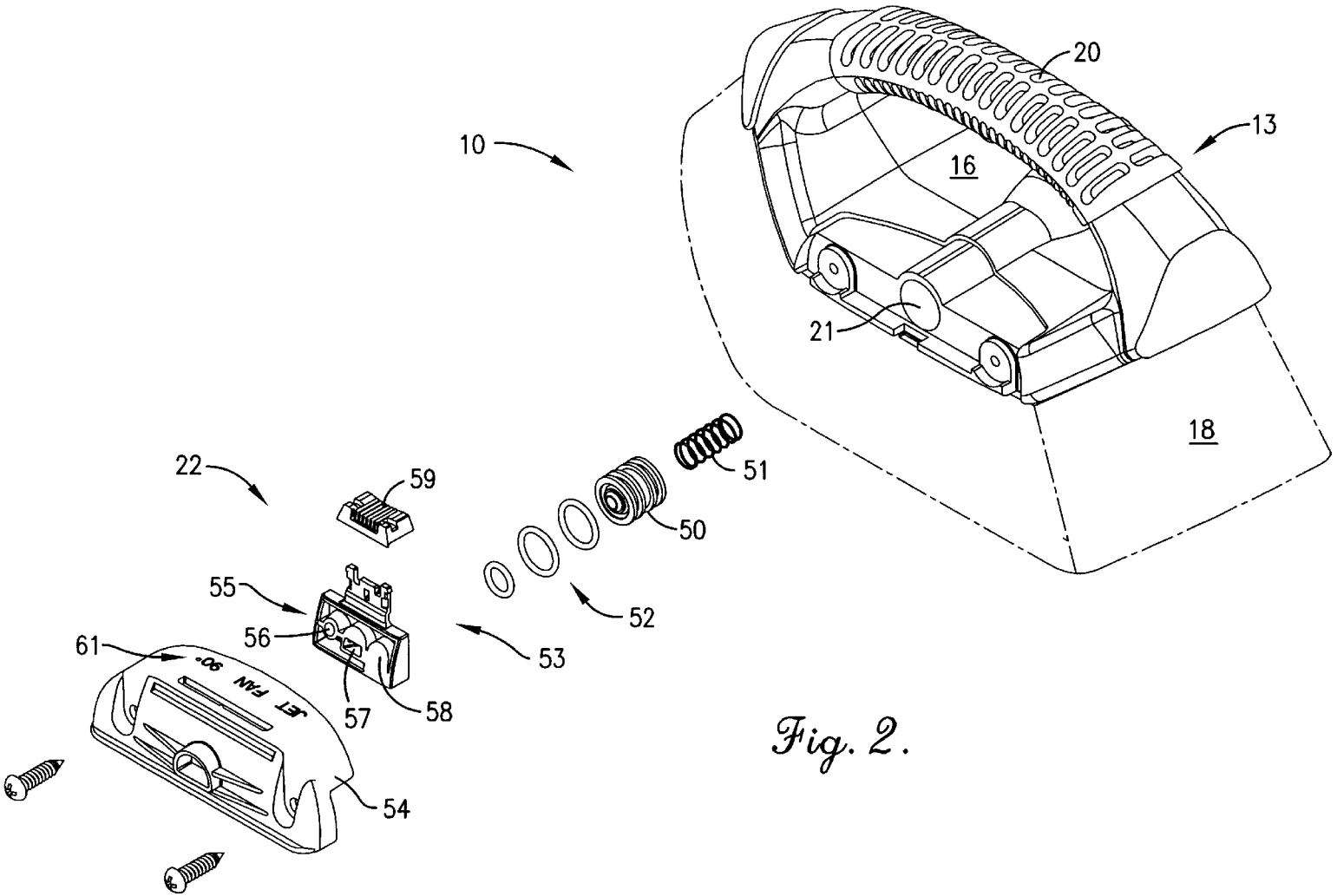
FIG. 2 is an exploded view showing in detail components of the head portion shown in FIG. 1.
Figure 5:
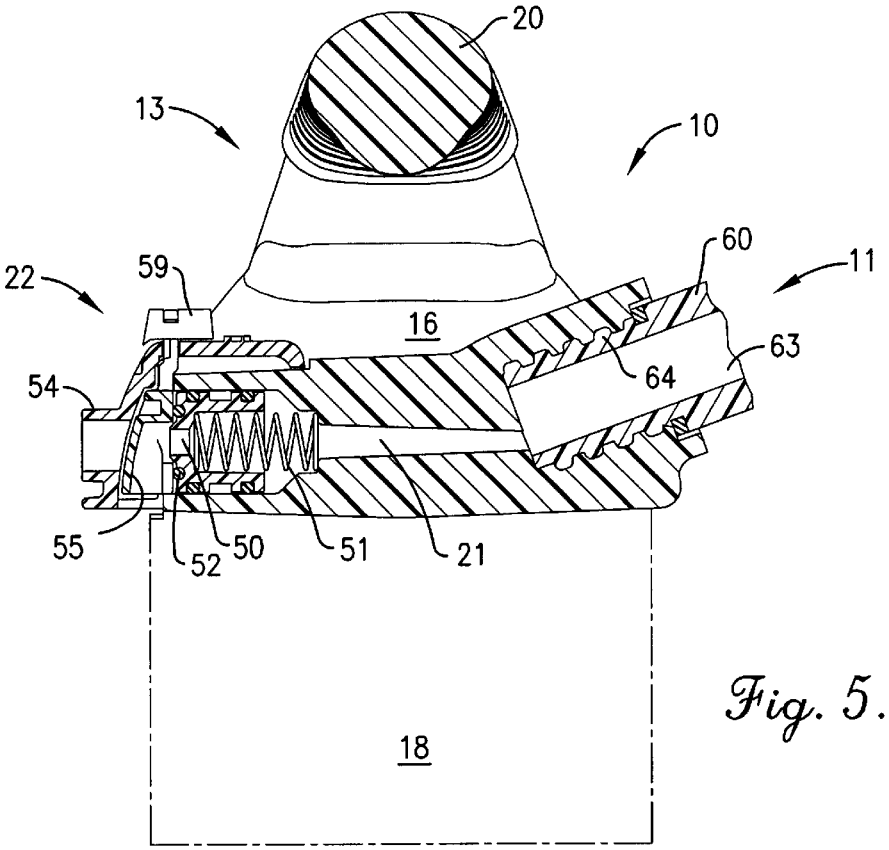
FIG. 5 is a fragmentary sectional right side plan view of the preferred embodiment shown in FIG. 3 taken along line 5—5 of FIG. 4.

Referring particularly to FIGS. 2 and 5, the flowpath control mechanism 22 is coupled with or incorporated into the front of the head body 16 and is operable to control one or more characteristics of the release of a liquid flowing through the flowpath 21 within the head body 16. The flowpath control 22 comprises a nozzle 50; a spring 51; one or more O-rings 52; a control plate 53; and a faceplate 54. The nozzle 50 fits into the flowpath 21 and presents an opening smaller than the flowpath 21, thereby increasing flow pressure. The spring 51 bias the nozzle 50 against the O-ring 52 interposed between the nozzle 50 and control plate 53 to prevent leaks.

Figure 7:
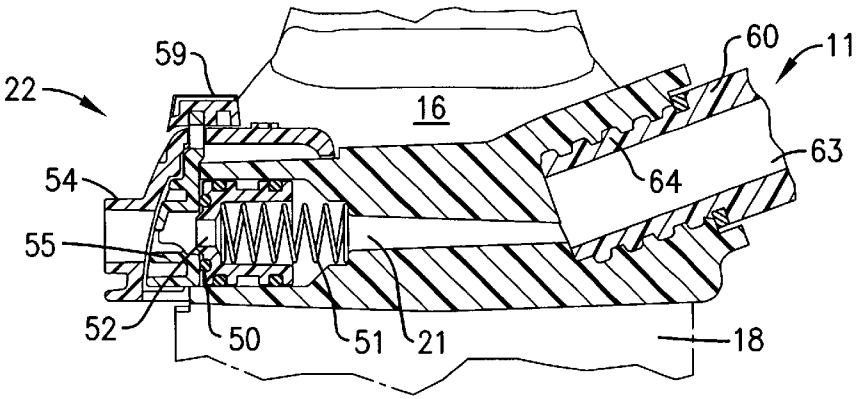
FIG. 7 is a fragmentary sectional right side elevational view of the preferred embodiment shown in FIG. 4 taken along line 7—7 of FIG. 6.
Figure 9:
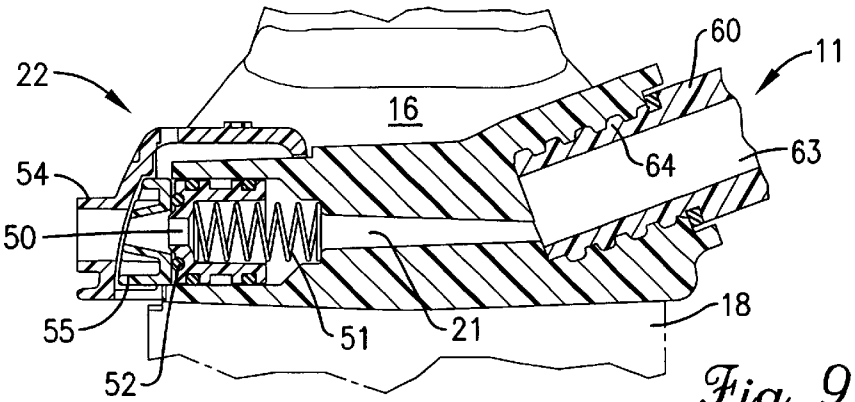
FIG. 9 is a fragmentary sectional right side elevational view of the preferred embodiment shown in FIG. 4 taken along line 9—9 of FIG. 8.
Figure 6:
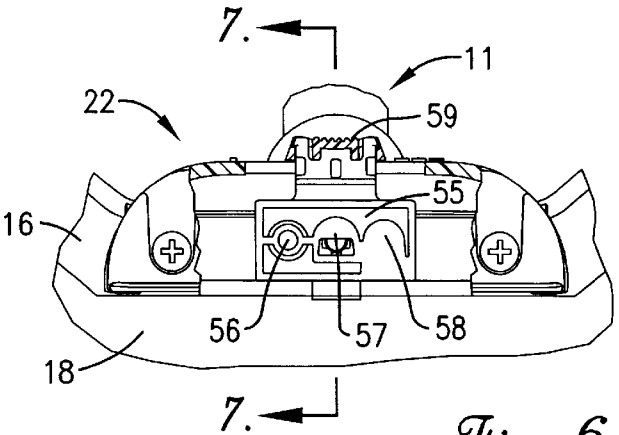
FIG. 6 is a fragmentary sectional front elevational view of the preferred embodiment shown in FIG. 4 further fragmented to focus on the flowpath control mechanism set in a first operating mode.
Figure 8:
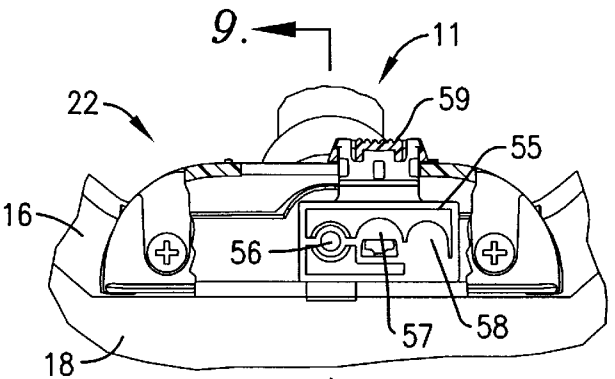
FIG. 8 is a is a fragmentary sectional front elevational view of the preferred embodiment shown in FIG. 4 and further fragmented to focus on the flowpath control mechanism set in a second operating mode.

The control plate 53 is shiftable relative to the nozzle 50so as to allow an operator to select one of three possible flow release characteristics. A selector switch 59 is included to facilitate shifting the control plate 53 to cause one of three tips 55 to align with the nozzle 50. The tips 55 shown include a jet spray tip 56 operable to produce a focused spray; a fan spray tip 57 operable to produce a diffuse spray; and a 90° tip 58 operable to direct release of the liquid downwardly perpendicular to the flowpath 21. For example, FIGS. 6 and 7 show the fan spray tip 57 selected, and FIGS. 8 and 9 show the jet spray tip 56 selected. It is further contemplated that the flowpath control 22 may where desirable and practical be constructed so as to provide selective control over other flow characteristics as well.

The faceplate 54 provides a protective cover and mounting points for securing the flowpath control mechanism 22 to the head body 16. Indicators 61 corresponding to selector switch positions and nozzle tip alignments is included for convenient operator reference when shifting the switch 59 to alter flow characteristics.

In operation, an operator desiring to use the wash brush 10 to clean a vehicle, for example, first chooses a handle 11 having an appropriate length, or, alternatively, adjusts the handle 11 to an appropriate length. The operator then securely couples head 13 with handle 11 using the ratchet-like coupling mechanism 12. As described in the above-identified copending application, such coupling involves simply screwing the threaded handle end 64 or handle adapter into the head 12 so that the first and second teeth of the coupling mechanism 12 engage.

The operator then screws an ordinary garden hose onto the handle's source connection end 62 to provide a source of water. Alternatively, the connection end 62 may be connected with any appropriate liquid source, including a source operable, for example, to provide a controlled mixture of soap and water.

The desired flow direction and pattern may then be set by shifting the selector switch 59 of the flowpath control mechanism 22. Furthermore, flow and pattern may be changed as desired during use. Furthermore, while washing, where additional scrubbing pressure is desired at the point of application of the cleaning material 18, the operator may grab the grip 20 and apply such downward pressure as may be required.

When finished washing, the process of assembling the wash brush 10 is reversed to allow for cleaning and storage. With regard to decoupling handle 11 from head 13, the ratchet-like action of the coupling mechanism 12 must be released to allow the handle 11 to be unscrewed, as is described in detail in the above-identified copending application.

From the preceding description, it can be seen that the wash brush 10 of the present invention provides a convenient and user-friendly cleaning tool having novel and non-obvious advantageous features including the ratchet-like coupling mechanism 12 for securely coupling handle 11 to head 13, and the flowpath control mechanism 22 for controlling the characteristics of release of a flow of liquid for application to the surface to be cleaned. Although the invention has been described with reference to the preferred embodiment illustrated in the attached drawings, it is noted that equivalents may be employed and substitutions made herein without departing from the scope of the invention as recited in the claims. For example, as described above, the present invention is independent of any particular application or cleaning material.

Having thus described the preferred embodiment of the invention, what is claimed as new and desired to be protected by Letters Patent includes the following:

1. A cleaning tool comprising:

a handle having an elongated hollow body providing a first flowpath and having first and second ends, the first end being coupleable to a liquid supply source;

a head providing a second flowpath and having a first end and an outlet second end, the first end is coupleable to the second end of the handle to result in alignment of the first and second flowpaths, a cleaning material comprising one of brush bristles and a sponge and being secured to and depending from the head; and a flowpath control mechanism having three spray tips and being coupled to the outlet second end of the head and operable to control one or more characteristics of release of a liquid flowing in the aligned first and second flowpaths and out of the outlet second end, the one or more characteristics of release of the liquid flow controlled by the flowpath control mechanism including a liquid flow substantially perpendicular to the second flowpath, a focused jet spray, and a diffuse jet spray.

2. The cleaning tool as set forth in claim 1, the handle having an adjustable length.

3. The cleaning tool as set forth in claim 1, the head including a grip portion.

4. The cleaning device as set forth in claim 1, the cleaning material being the brush bristles.

5. The cleaning tool as set forth in claim 1, the cleaning material being the sponge.

6. The cleaning tool as set forth in claim 1, the flowpath control mechanism being operable to provide the focused jet spray of the liquid.

7. The cleaning tool as set forth in claim 1, the flowpath control mechanism being operable to provide the diffuse fan spray of the liquid.

8. The cleaning tool as set forth in claim 1, the flowpath control mechanism being operable to cause the liquid to be released substantially perpendicular to the second flowpath.

9. A cleaning tool comprising:

a handle having an elongated hollow body providing a first flowpath and having first and second ends, the first end being coupleable to a liquid supply source;

a head providing a second flowpath and having a first end and an outlet second end, the first end is coupleable to the second end of the handle to result in alignment of the first and second flowpaths, and the head providing an attachment mechanism for removably securing a cleaning material. thereto, the cleaning material comprising one of brush bristles and a sponge; and a flowpath control mechanism having three spray tips and being coupled to the outlet second end of the head and operable to control one or more characteristics of release of a liquid flowing in the aligned first and second flowpaths and out of the outlet second end, the one or more characteristics of release of the liquid flow controlled by the flowpath control mechanism including a liquid flow substantially perpendicular to the second flowpath, a focused jet spray, and a diffuse fan spray.

10. The cleaning tool as set forth in claim 9, the handle having an adjustable length.

11. The cleaning tool as set forth in claim 9, the head including a grip portion.

12. The cleaning tool as set forth in claim 9, the flowpath control mechanism being operable to provide the focused jet spray of the liquid.

13. The cleaning tool as set forth in claim 9, the flowpath control mechanism being operable to provide the diffuse fan spray of the liquid.

14. The cleaning tool as set forth in claim 9, the flowpath control mechanism being operable to cause the liquid to be released substantially perpendicular to the second flowpath.

15. A cleaning tool comprising:

a handle having an elongated hollow body providing a first flowpath and having first and second ends, the first end being coupleable to a liquid supply source, the second end presenting a set of first teeth arranged circumferentially thereabout;

a coupling mechanism having a set of second teeth operable to releaseably engage the first teeth of the second end of the handle;

a head having a first end and an outlet second end, the first end is secured to the coupling mechanism and providing a second flowpath alignable with the first flowpath of the handle;

a cleaning material comprising one of brush bristles and a sponge secured to and depending from the head; and a flowpath control mechanism having three spray tips and being coupled to the outlet second end of the head and operable to control one or more characteristics of release of a liquid flowing in the aligned first and second flowpaths and out of the outlet second end, the one or more characteristics of release of the liquid flow controlled by the flowpath control mechanism including a liquid flow substantially perpendicular to the second flowpath, a focused jet spray, and a diffuse jet spray.

16. The cleaning tool as set forth in claim 15 the handle having an adjustable length.

17. The cleaning device as set forth in claim 15, the cleaning material being the brush bristles.

18. The cleaning tool as set forth in claim 15, the cleaning material being the sponge.

19. The cleaning tool as set forth in claim 15, the flowpath control mechanism being operable to provide the focused jet spray of the liquid.

20. The cleaning tool as set forth in claim 15, the flowpath control mechanism being operable to provide the diffuse fan spray of the liquid.

21. The cleaning tool as set forth in claim 15, the flowpath control mechanism being operable to cause the liquid to be released substantially perpendicular to the second flowpath.

* * * * *